US005722679A

United States Patent [19]

Challande et al.

[11] Patent Number: 5,722,679

[45] Date of Patent: Mar. 3, 1998

[54] ELEMENT ASSEMBLY FOR RETAINING SHOES OR BOOTS ON A GLIDING BOARD

[75] Inventors: Christian Challande, Cruseilles; Pierre Desarmaux, Evires, both of France; Hans Horn, Lysse, Switzerland

[73] Assignee: Salomon S.A., Metz-Tessy, France

[21] Appl. No.: 559,143

[22] Filed: Nov. 17, 1995

[30] Foreign Application Priority Data

Nov. 21, 1994 [FR] France ..... 94 14073

[51] Int. Cl.[6] ..... A63C 9/088

[52] U.S. Cl. ..... 280/612; 280/630; 280/634; 280/DIG. 13

[58] Field of Search ..... 280/611, 612, 280/613, 626, 629, 630, DIG. 13, 634

[56] References Cited

U.S. PATENT DOCUMENTS

| | | | |
|---|---|---|---|
| 3,960,383 | 6/1976 | O'Neil | 280/612 |
| 4,156,534 | 5/1979 | Salomon | 280/612 |
| 4,502,146 | 2/1985 | D'Antonio | 280/612 X |
| 4,563,021 | 1/1986 | Klubitschiko | 280/612 |
| 4,589,673 | 5/1986 | Dimier et al. | 280/630 |
| 4,883,286 | 11/1989 | Hornschemeyer | 280/629 |
| 5,213,358 | 5/1993 | Badura | 280/612 |

FOREIGN PATENT DOCUMENTS

| | | |
|---|---|---|
| 313761 | 1/1974 | Austria . |
| 0302309 | 2/1989 | European Pat. Off. . |
| 0580021 | 1/1994 | European Pat. Off. . |
| 1503847 | 12/1967 | France . |
| 1503848 | 12/1967 | France . |
| 1503849 | 12/1967 | France . |
| 1807074 | 5/1970 | Germany . |
| 4305327 | 3/1994 | Germany . |

*Primary Examiner*—Brian L. Johnson
*Assistant Examiner*—Michael Mar
*Attorney, Agent, or Firm*—Greenblum & Bernstein, P.L.C.

[57] ABSTRACT

The invention relates to an assembly of two retention elements of two boots of a skier on two skis. Each retention element has a retention jaw, a return spring of the jaw, a linkage for transmission of movement between the retention jaw and the spring, an adjustment mechanism acting on the transmission linkage to modify in a differential manner the release threshold of the jaw depending upon which it displaces from one side or the other with respect to its aligned position, a manipulation element adapted to be activated from the other retention element and to control the adjustment mechanism.

14 Claims, 13 Drawing Sheets

Fig- 3
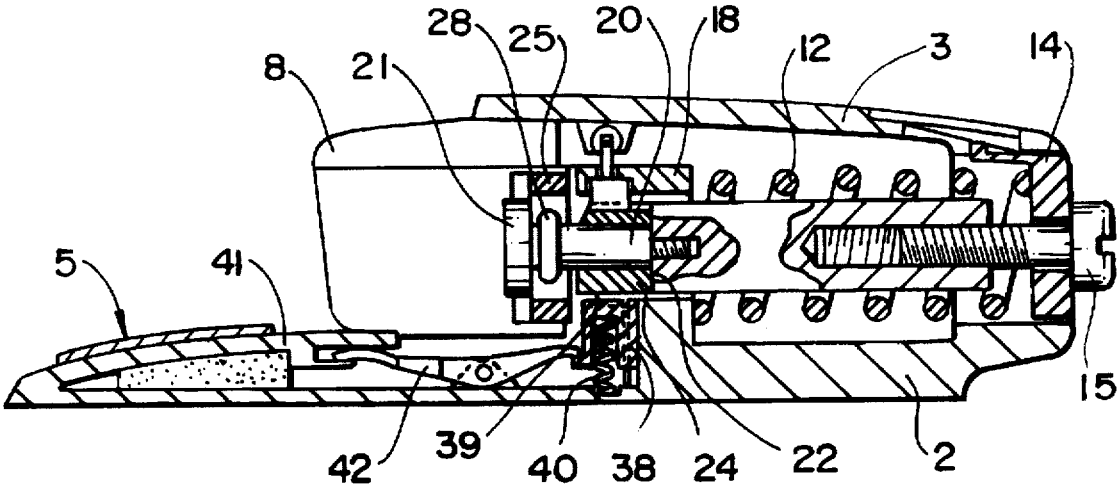
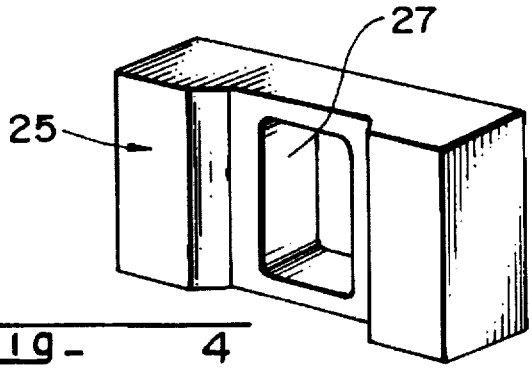
Fig- 4
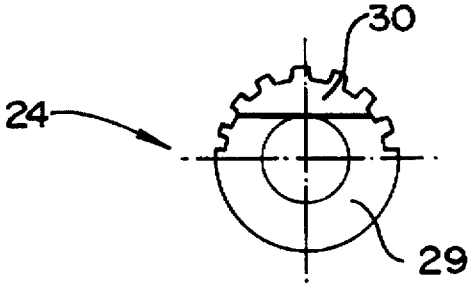
Fig- 5
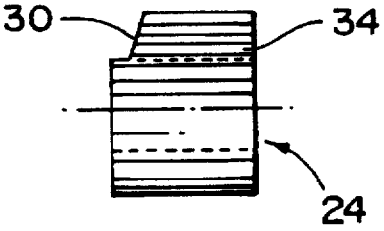
Fig- 6

ELEMENT ASSEMBLY FOR RETAINING SHOES OR BOOTS ON A GLIDING BOARD

BACKGROUND OF THE INVENTION

1. Field of the Invention

The present invention relates to an assembly of two retention elements adapted to retain the boots of a skier on a pair of gliding boards, in particular on a pair of skis.

The invention likewise relates to an assembly of two retention elements associated with an assembly of right and left boots for each of the feet of a skier.

2. Description of Relevant Materials

In the case of an alpine ski, it is known to retain a boot supported on a ski by means of a front binding element and a rear binding element which retain the front and rear tips of the boot. These two binding elements comprise a jaw carried by a body. The jaw is movable in response to the biases of the boot against the return force of a spring which opposes its displacement.

The stiffness of the spring is adjustable, in a manner such that the boot is released from the binding element for a bias exceeding a predetermined threshold force. This threshold is commonly called a release threshold.

In order to be able to utilize boots with the different binding elements available on the market, the form of the front and rear tips of the boot has been standardized. In the ISO standardization system, the relevant standard in this case is ISO 5355. As for the binding elements are provided to be compatible with the standardized zones of the boot and to assure the release of the boot at predetermined release values.

At the front, a boot is retained by a front binding or retention element whose jaw is movable at least laterally towards the interior or the exterior of the foot. The jaw of the retention element is adapted to release. the boot during an excessive torsional bias being exerted on the leg of the skier. The current bindings have a release threshold which is in general equal towards the interior and exterior of the foot.

Yet, it is known that the knee of the skier, which is biased during a torsional fall is more fragile for a rotation of the foot towards the interior than for a rotation towards the exterior.

To take this into account, binding elements which have been proposed have a different release threshold depending upon the direction of rocking of the jaw. Such elements are, for example, described in French Patents 1,503,847; 1,503,848; 1,503,849; and further, in German published application No. 18 07 074.

The major disadvantage of this type of apparatus is that it requires a pairing between the boots and the skis, i.e., the right and left skis must be necessarily referenced, and the skier must put the right ski onto the right boot and the left ski onto the left boot. However, it is practically possible to reverse the two skis, i.e., to put the left ski onto the right boot for example. In this case, the effect of the asymmetry in the release of the binding acts in the reverse manner, without it being possible to correct this other than by exchanging the two skis.

The problem posed by the invention is to improve the mode of operation of existing retention elements. In particular, it comprises providing retention elements with an asymmetric release threshold, and improving the operation of such retention elements having an asymmetric release threshold.

This problem is resolved by the retention element assembly of a boot such as defined below.

SUMMARY OF THE INVENTION

Each retention element has a retention jaw of the boot which is laterally movable, on both sides, towards the interior or exterior of the ski, against the return force of a spring. The jaw and the spring are adapted to be able to release the boot beyond a predetermined release threshold. Each retention element is furthermore equipped with an adjustment mechanism, which makes it possible to adjust at will the release threshold of the retention element in an asymmetric manner, according to the direction of displacement of the jaw, and an actuation of the adjustment mechanism which is controlled by the other retention element of the pair. Thus, when the skis are placed flat on the ground, and the ski puts them on, the retention element are polarized with respect to one another automatically, or by means of a simple manipulation of the skis.

This polarization of the retention elements occurs at the moment that the skis are put on, such that, whatever the direction in which the skier presents his skis, each retention element will polarize itself along its right or left position relative to the other element.

As a result of this polarization, the release threshold of each of the retention elements is smaller for a release of the boot towards the exterior than for a release towards the interior of the retention element.

BRIEF DESCRIPTION OF THE DRAWINGS

The invention will be better understood with reference to the description below and to the annexed drawings which are an integral portion thereof.

FIG. 3 is a lateral cross-sectional view of the element of FIG. 1.

FIG. 4 is a perspective view of the rocker.

FIG. 5 is a front view of the polarization ring.

FIG. 6 is a side view of the ring of FIG. 5.

DETAILED DESCRIPTION OF THE INVENTION

Figure 1:
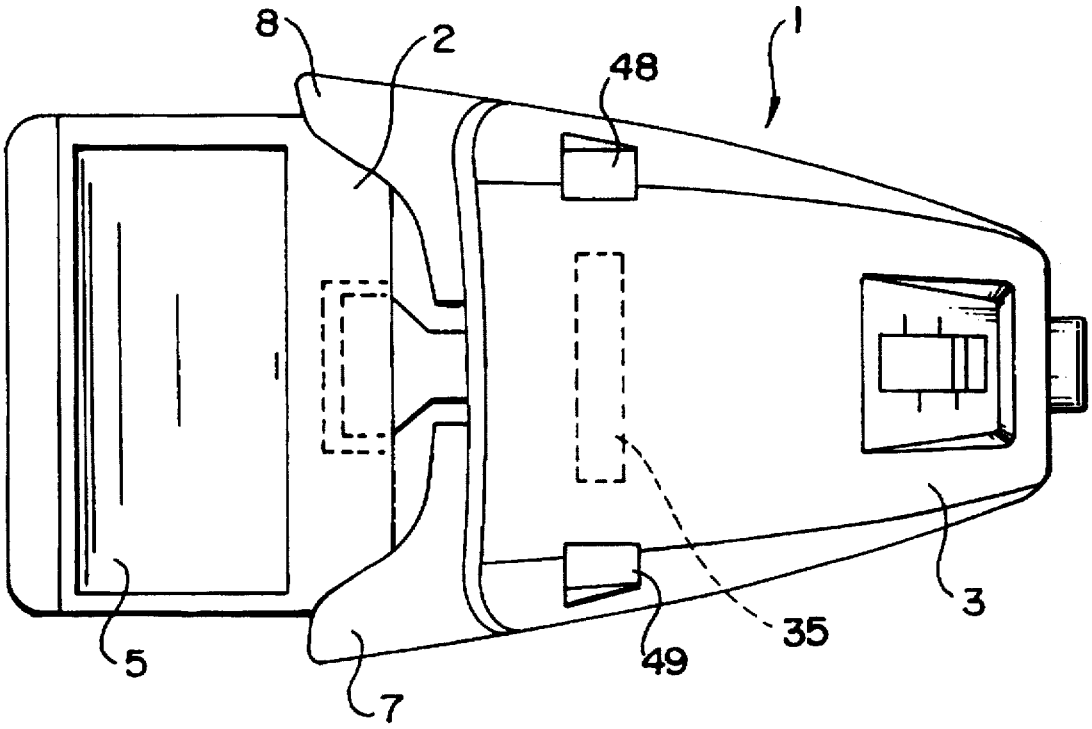
FIG. 1 is a general top view of a retention element according to a first embodiment of the invention.
Figure 2:
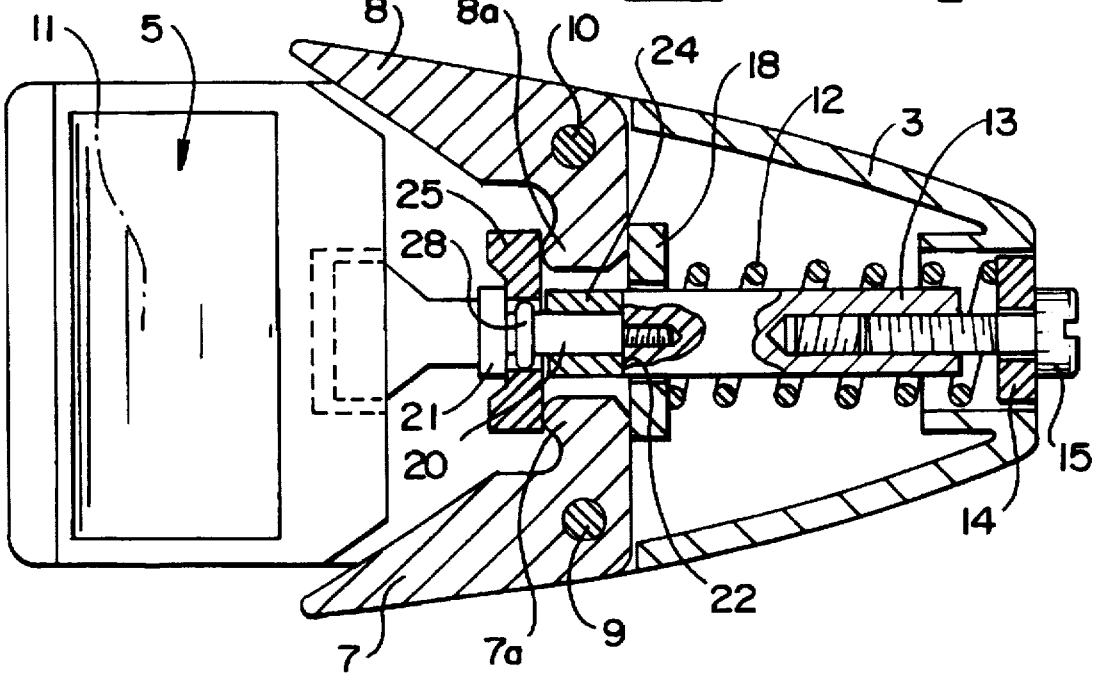
FIG. 2 is a top cross-sectional view and of the retention element of FIG. 1.

FIGS. 1–3 show a retention element 1 by way of illustration of the invention. The two retention elements of the assembly are constructed in an identical manner. In order to simplify the notation of the references, the same reference numerals will be used for the same elements of the two retention elements, when they are designated in a general manner, and they will be used as prime or double prime when they are designated as a specific member of the retention element prime of the retention element double prime, respectively, of the assembly.

Element 1 shown in FIGS. 1–3 comprise a base 2 capped with a hollow body or cap 3 having a lateral wall and an upper cap. Base 2 is extended towards the rear to form a support element 5 adapted to receive the sole of the boot.

In addition, the retention element has a jaw formed of two wings 7 and 8 for retaining the boot. In their embodiment illustrated in the figures, the wings are independent, respectively journalled around vertical axes 9 and 10. The wings are extended respectively towards the interior, beyond axes 9 and 10 by returns 7*a* and 8*a*. Furthermore, the wings comprise a sole clamp which assures the vertical retention of the boot, in addition to the lateral retention. This case is not limiting, and the jaw could be of another type, particularly it could be monoblock, fixedly connected to a body pivotably mounted around a central pivot. Numerous known constructions are possible. At rest, the jaw has a position which is substantially aligned with the longitudinal axis defined by the ski. In the case illustrated, the wings 7 and 8, at rest, are closed towards the longitudinal median axis which has schematically been shown by lead line 11 in FIG. 2.

Body 3 of the retention element houses spring 12, to which are transmitted the bias forces that the boot exerts on the wings of the jaw, and which, in return, exert an elastic return force on the wings in the direction of their respective resting positions.

The spring is connected to the jaw by a movement transmission linkage.

In the embodiment shown in FIGS. 1–3, the linkage between the spring and the wings of the jaw comprises a longitudinal tie rod 13 which is cylindrical. The tie rod is engaged in the coils of the spring. It has at its front end a stop washer 14 against which the front end of the spring is supported. The washer is connected to the end of the spring by a screw 15 which makes it possible to adjust the initial compression of the spring. The screw 15 is accessible from the front of the retention element across an opening of the cap.

Towards the rear, the spring is supported against a support wall 18 which is integral with the body or its base. In the embodiment illustrated, the support wall 18 serves likewise as an abutment for the returns 7*a* and 8*a* of the wings, for rotation of the wings towards the interior. This position in abutment against the support wall defines the rest position of each of the wings. The tie rod extends through wall 18 and opens towards the rear between the two wings. At this level, it has a portion 20 of smaller diameter, with a head 21. At the beginning of this portion of smaller diameter, the tie rod has a shoulder 22. On the portion of smaller diameter are mounted a ring 24, on the side of shoulder 22, and a floating rocker 25 on the side of head 21. The floating rocker is wider than head 21, and its dimensions are such that it offers to the returns 7*a* and 8*a* of the wings a support surface through which the returns of the wings can bias the tie rod from front to rear against the return force of the spring. Preferably, the portion 20 of smaller diameter is an independent element which is assembled for example by screwing or any other appropriate means to the rest of the tie rod.

Rocker 25 is maintained on portion 20 of the tie rod, in support between its head 21 and return 7*a* and 8*a* of the wings. Preferably, head 21 of the tie rod has a square cross section, and the tie rod laterally has two beads which give a good support for the rocker, particularly in the course of oscillation movements which will be described below. Towards the front, rocker 25 is supported against the ring 24. Ring 24 is pivotably mounted around the portion 20 of the tie rod. Towards the front the ring is supported against shoulder 22. In a preferred manner, the ring has an external diameter equal to that of the front portion of the tie rod, but this is not essential. Preferably likewise, the ring has a length greater than the extent of the tie rod between the resting position and the release of the boot. The assembly of the rocker and the ring is adapted such that, at least at rest, the ring can pivot freely around the portion 20. This is to say that the rocker and the ring are mounted on the tie rod, between the head and the shoulder 22 with a slight play along a longitudinal direction.

The rocker 25 is floating, i.e., that it can oscillate in a horizontal plane, as a function of the position and of the displacement of its different supports.

In the embodiment shown, the rocker has a large central opening 27 of rectangular shape. Seen from above, the width of this opening is greater than the diameter of the portion 20 of the tie rod, and, preferably, this portion 20 has a small collar 28 having a rounded edge, whose external diameter is substantially equal to the width of the opening 27. This small collar serves as a support for the oscillation of a rocker, which will be described in greater detail below. The width of opening 27 is however less than the diameter of ring 24.

Seen from the side, opening 27 has a height which is slightly greater than the external diameter of ring 25. The portion 20 of the tie rod is maintained at mid height of opening 27 by any appropriate means.

Ring 24 has on the side of the rocker a planar support surface, which is vertical, except over a quarter of a circle approximately where the support surface is retracted. The planar and vertical zone is identified as 29 in the figures, and the retracted zone is identified at 30. In the position of the ring shown in FIGS. 1 and 2, this zone 30 is aligned with the longitudinal median plane, towards the top, above the portion 20 of the tie rod. It can also be below the portion 20. This position will be qualified below as the median position.

Figure 7:
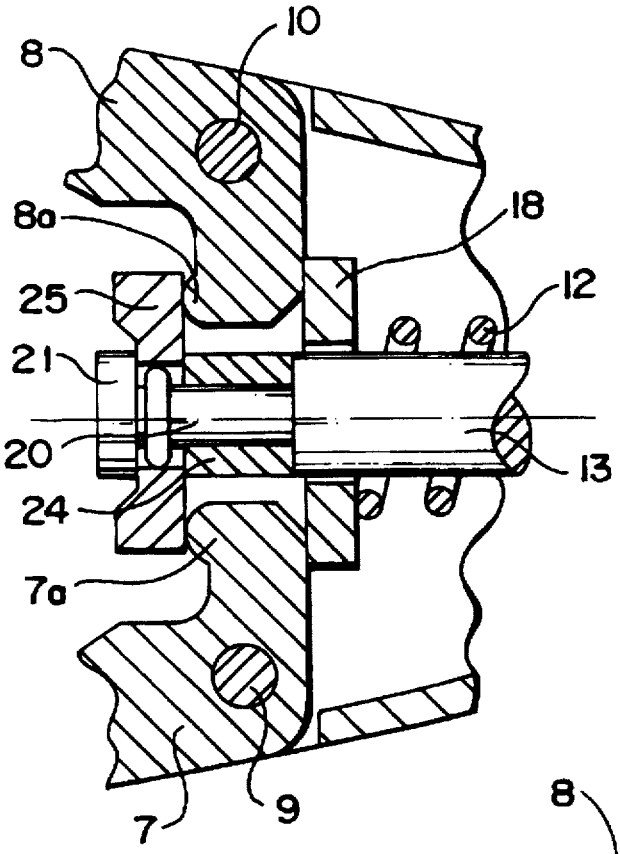
FIGS. 7–11 are partial cross-sectional views of the retention element at the level of the linkage between the wings and the tie rod, and illustrate the operation of this linkage.
Figure 8:
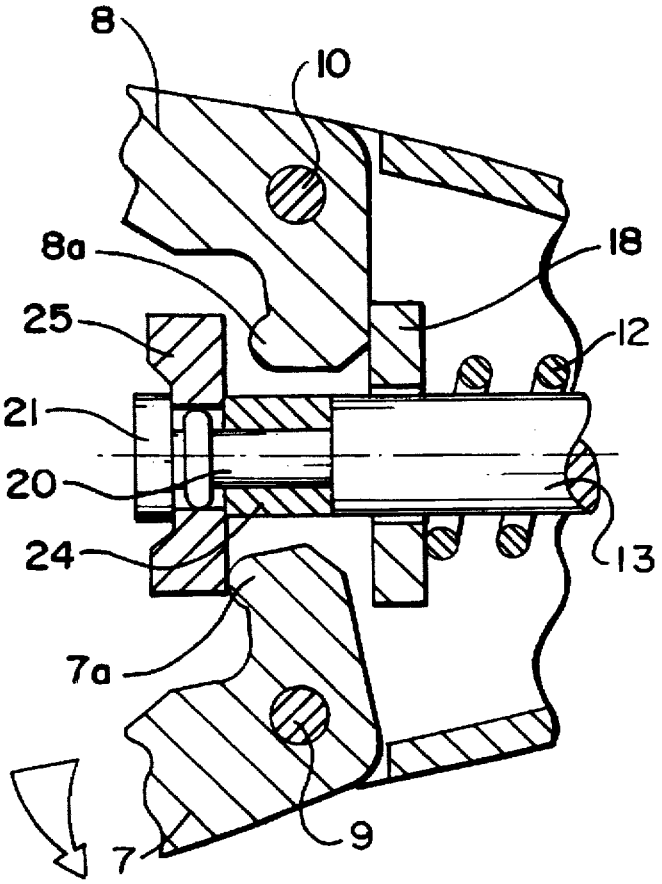

The construction which has just been described operates in the following manner. FIGS. 7 and 8 illustrate the linkage between the wings and the tie rod in the median position of the ring. In FIG. 7, the wings are at rest, in the closed position. In FIG. 8, one of the wings, wing 7 in this case, is open. The return 8*a* of the wing has driven rocker 25. Rocker 25 is maintained on one side by head 20 of the tie rod, and on the other side, by reaction, it is supported against the ring 24 on both sides of the longitudinal median axis. The rocker is displaced with the tie rod while remaining perpendicular to the tie rod.

Figure 9:
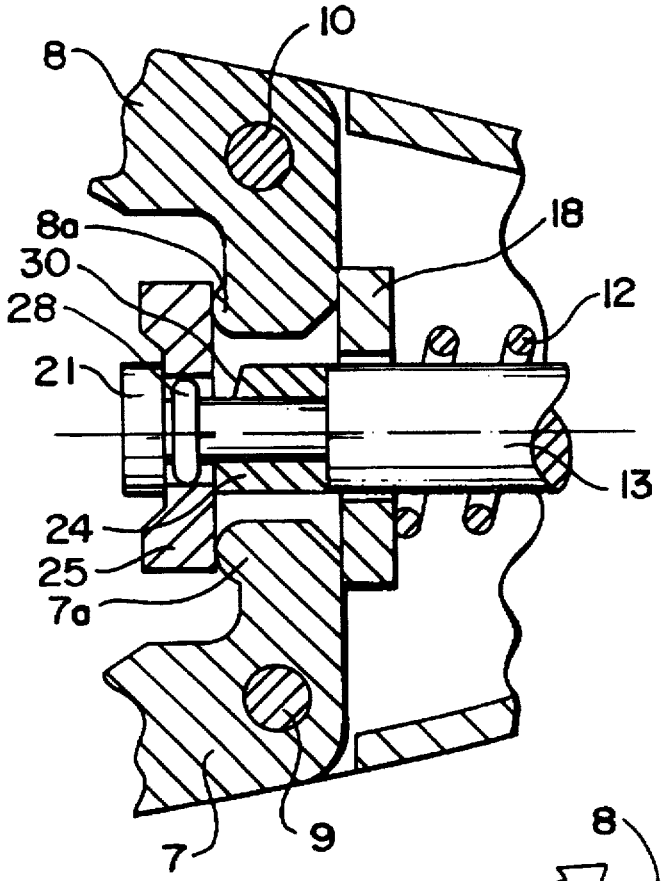

FIG. 9 illustrates the construction after a rotation of the ring 24 over a quarter of a turn. This rotation has brought the retraction zone 30 of the rocker towards the return 8*a* of the wing 8.

Figure 10:
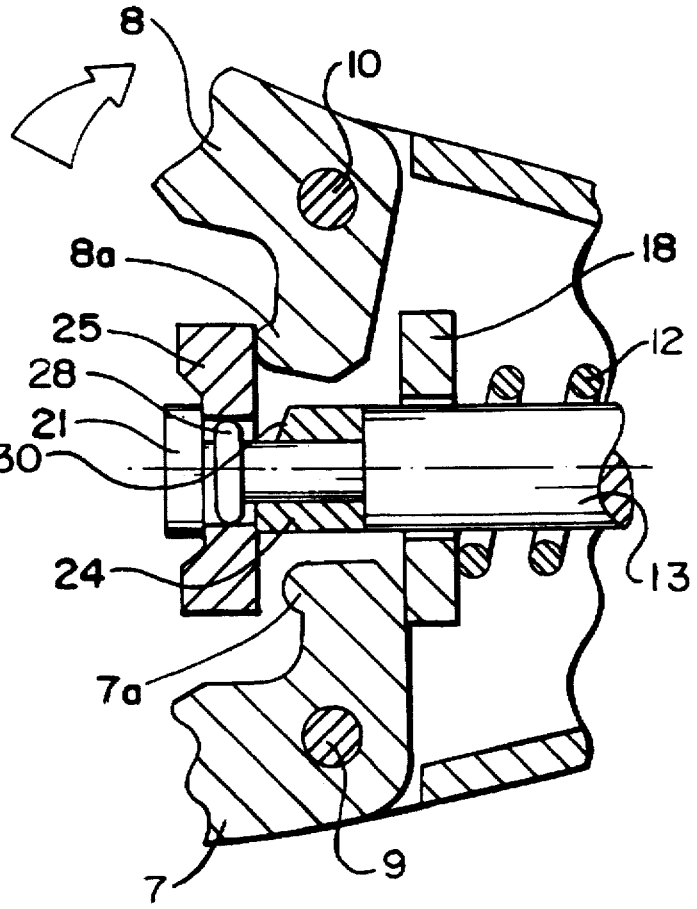

In FIG. 10, wing 8 is open. In its rotational movement, the wing has moved the rocker 25. The rocker is supported on the head of the tie rod, and, by reaction on ring 24 in the zone diametrically opposed to the zone 30. The rocker behaves in the same manner as that which has been previously described.

Figure 11:
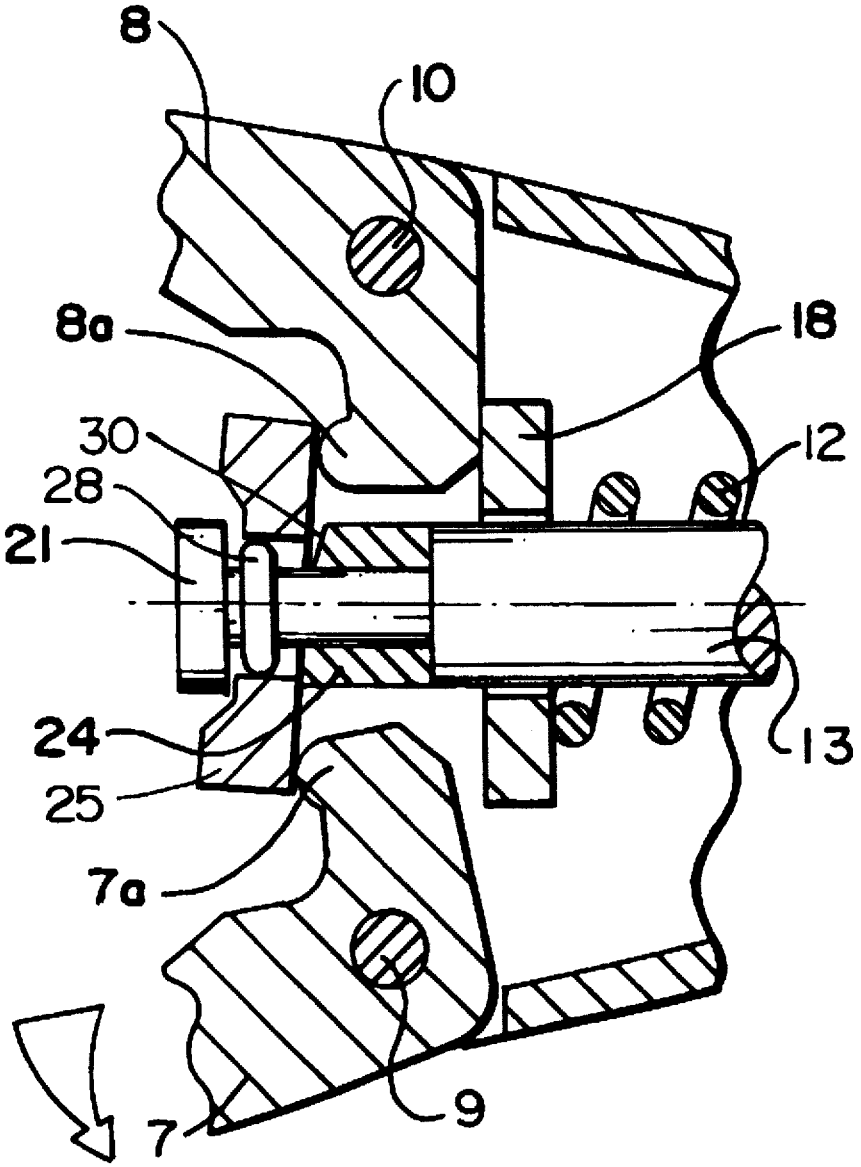

FIG. 11 illustrates the rotation of the other wing, i.e., wing 7. As previously, the rocker drives head 21 of the tie rod, but this time, the rocker is supported by reaction no longer against ring 24 but against return 8*a* of the other wing. In effect, the rocker cannot be supported against ring 24 by virtue of the retraction zone 30. Wing 8 is itself retained by the support wall 18. Rocker 25 no longer directly transmits its movement to the tie rod, it functions as a lever, which pivots by support on return 8*a*. Taking into account the lever arm difference, the return force which opposes the opening of the wing is reduced. The opening of wing 7*a* is facilitated in this position of ring 24.

Preferably, zone 30 is sufficiently retracted such that wing 7 frees the boot before rocker 25 reaches the end of zone 30. In this manner, rocker 30 remains supported against the return of wing 8, and the reduction effect is maintained. Furthermore, opening 27 of rocker 30 is adapted in height so as not to hinder the oscillation of the rocker, i.e., that it is greater than the external diameter of the ring.

It is self evident that the ring 24 can also be pivoted in the other direction, so as to obtain the same reduction effect upon opening of the other wing.

The retention element furthermore comprises control means for determining the position of the ring according to the relative position of the retention element with respect to the other element of the assembly.

According to the embodiment illustrated, ring 24 has over half of its periphery a channeled zone 34. The channels are oriented parallel to the longitudinal direction of displacement of the tie rod. Preferably, in the median position of the ring, this zone is located on top of the ring.

A rack 35 is adapted so as to mesh with the channels of ring 24. The rack 35 is guided along a transverse translational movement in a groove carried by the support wall 18. Naturally any other appropriate guidance means may be used.

Preferably, rack 35 or ring 24 has means for elastic return into to the median position, i.e., the position of operation corresponding to FIGS. 7 and 8. The rack carries in its upper portion a vertical shaft 36. Shaft 36 is hooked between two transverse springs 37*a* and 37*b* which are furthermore retained by abutments affixed to cap 3, and which return shaft 36 to its median position. Any appropriate means may be used.

According to the embodiment of the invention shown in FIGS. 1–13, rack 35 is constructed as a north-south oriented magnet along the horizontal and transverse direction of the retention element. For example, the rack is formed by a bar magnet attached above a neutral plate carrying the teeth. The cap 3 and the other members of the retention element are likewise formed out of a material neutral to the magnetic radiation, for example a plastic material, or alloys of non-ferrous metals.

The north-south orientation is arbitrary, but it is identical for the two elements of a pair.

Figure 12:
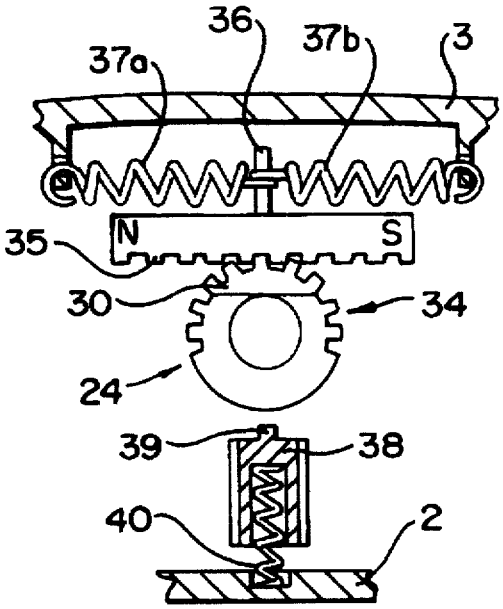
FIG. 12 schematically illustrates a front view of the linkage between the ring and the tie rod.

FIG. 12 illustrates the ring 24 and the rack 35 in the median position.

Figure 13:
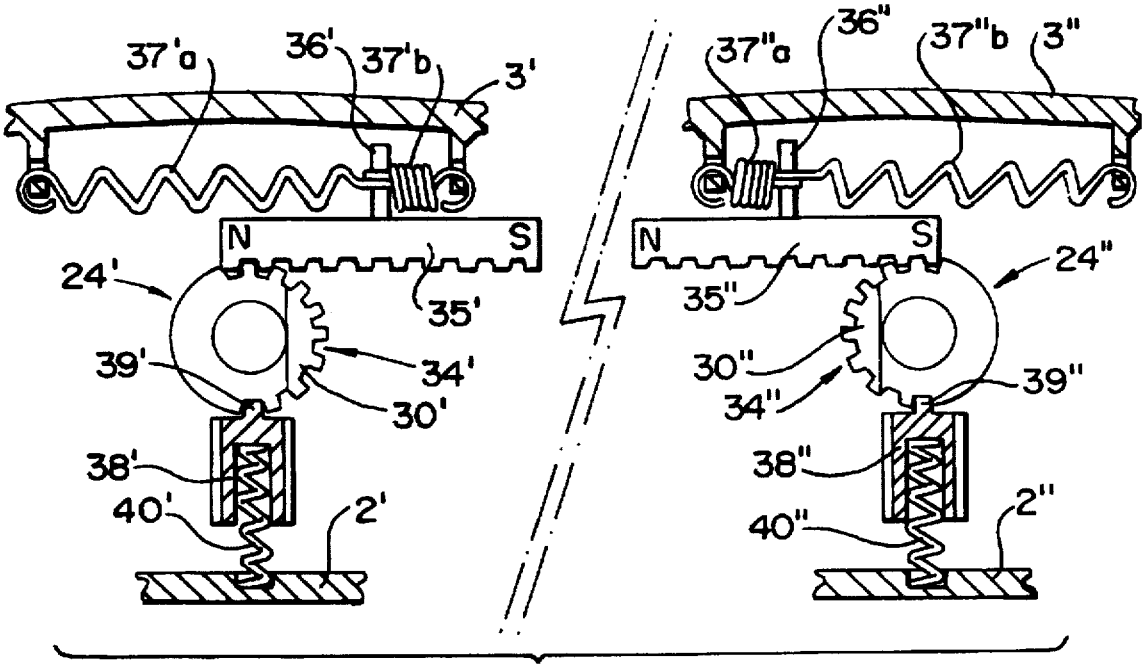
FIG. 13 illustrates the operation of the linkages between the ring and the tie rod of the two retention elements side by side.

FIG. 13 illustrates these same members for the two retention elements placed side by side. The retention elements are for example placed thus when the skis are put down flat, ready to have the boots put thereon. As mentioned previously, the members of each element assembly have respectively been identified with the prime and double prime designations (24', 24", 35', 35", . . . ).

The two magnets of the racks 35' and 35" are polarized in the same direction, such that regardless of the relative position of the two retention elements, the two magnets attract one another and displace towards one another.

They bring with them rings 24' and 24" in opposite directions of rotation, which results in a symmetrical polarization of each of the retention elements.

By virtue of this polarization, the wings which are positioned towards the exterior of each of the retention elements are adapted to release the boot more easily, i.e., with a release threshold which is lower than the interior wings. The boot of the skier will as a result be released for a torsional bias of the leg and of the knee of the skier which is smaller towards the interior of the foot than towards the exterior.

To avoid that the polarization is modified in the course of skiing, preferably, a latching means blocks each ring once it has reached its polarization position.

In FIGS. 1–13, this means is shown in the form of a latch 38 which is vertically movable under wing 24. The latch carries in its upper portion a tooth 39 which is adapted to be able to engage it in a channel of the ring. The latch 38 is elastically returned upwardly by a spring 40 positioned at its lower portion.

A control sensor is provided to bring back the latch 38 downwardly, against the return force of spring 40, or to free it at will. The sensor is here the support plate of the boot which has an upper portion 41 which is vertically movable, and elastically returned upwardly, for example by deformation of an elastically deformable zone forming an elastic hinge positioned at the rear of the upper portion. Furthermore, a layer of an elastically deformable material can be interposed between portion 41 and the rest of the plate, to elastically return the plate, and also to fill this space and avoid snow or dirt infiltrating therein.

In front, the upper portion 41 is supported against the arm of a rocker 42 which is movable around a transverse axis, whose other arm is adapted to lower the latch 38, for example by being supported on an edge positioned at its base. A small tongue connected to the movable end of portion 41 continues below the arm of the rocker 42 to subject with the movement of the rocker to the movement of this end of portion 41. Naturally, any other appropriate means may be used.

The latching means operates in the following manner. The positioning of the skis side by side causes the transverse translation of the racks 35' and 35", and the rotation of rings 24' and 24" over an angular amplitude of a quarter of a turn, to bring the retracted zones 30' and 30" from one side and the other of portion 20 of the tie rods, respectively. For each of the rings, this rotation brings the first channel directly in vertical line with the axis of the portion 20 of the tie rod, in front of the tooth 39 of the latch 38.

Upon engagement of the boot, the portion 41 of the support plate is lowered, freeing the latch 38 which rises under the pressure of spring 40, which causes the engagement of the tooth 39 in the channel, and the latching of the ring. The rings are immobilized in their respective position as long as the boots are engaged in their retention element.

It should be noted that in the course of skiing, the ring can be displaced along a longitudinal direction with the tie rod, the latch and the rack are not displaced longitudinally, but they slide along the channels in which they are respectively engaged.

The blockage of the ring by the latch 38 can likewise occur after engagement of the boot. In effect, in this case, upon engagement of the boot, the tooth 39 is pushed against the smooth surface of the ring, which can then pivot during the coming together of the two retention elements, until the first channel is in front of facing tooth 39. The tooth then immobilizes the ring.

When the boot is freed from the retention element, in an accidental manner or in a voluntary fashion, portion 41 of the support plate rises, which brings the latch 38 downwardly. The ring is freed, and one of the upper springs 37*a* or 37*b*, the one of the two which has been stretched, returns the rack 35 and the ring to the median position.

Figure 14:
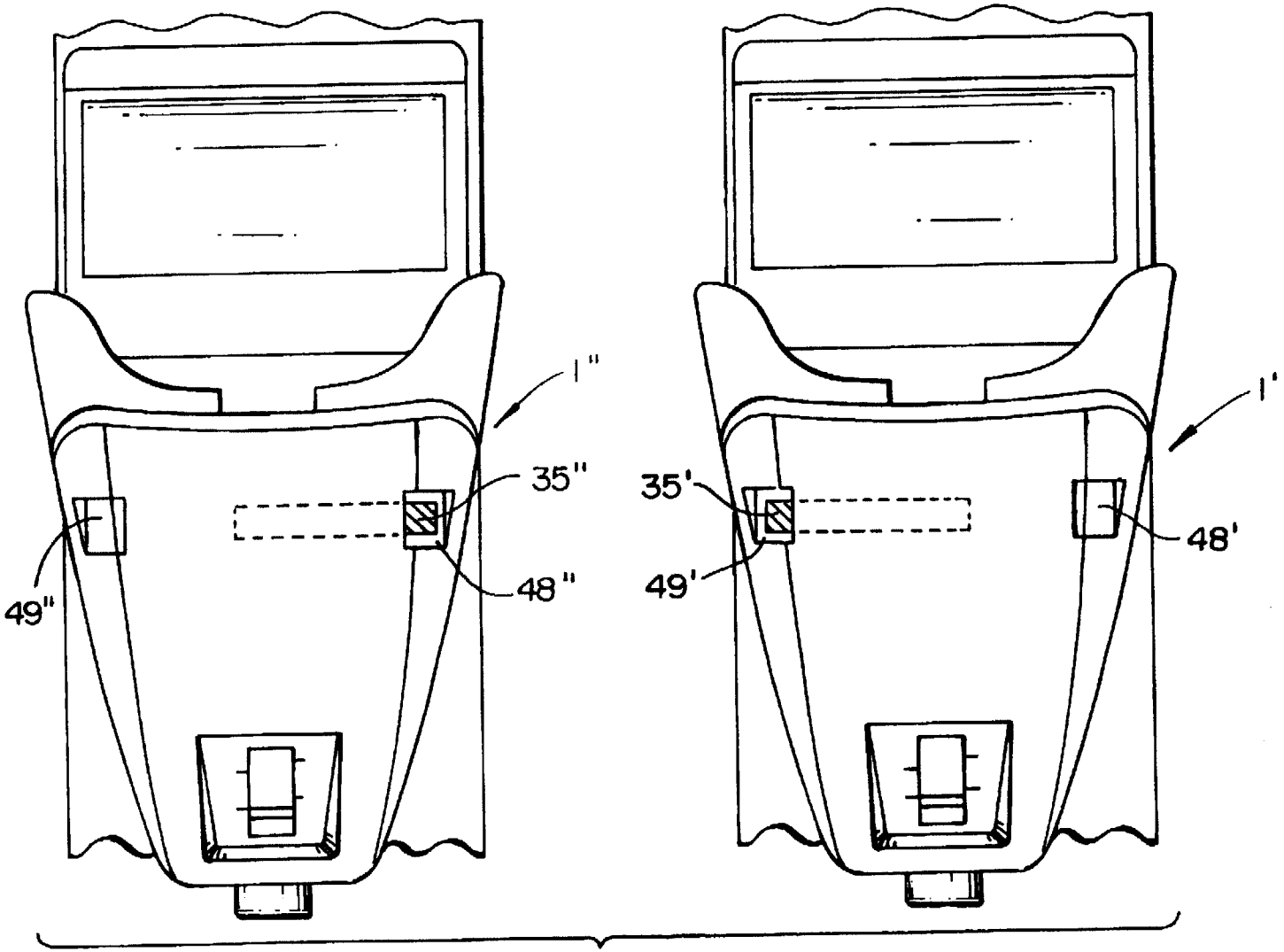
FIG. 14 illustrates, in top view an assembly of two retention elements according to the embodiment of FIG. 1.

Preferably, as shown in FIGS. 1 and 14, the retention element has transparent windows 48 and 49, towards each edge, through which it is possible to see the rack 35, and thus to control its correct placement. In FIG. 14, the racks 35' and 35" are visible across the two external windows 48' and 48". Naturally, any other appropriate means may be used.

Figure 15:
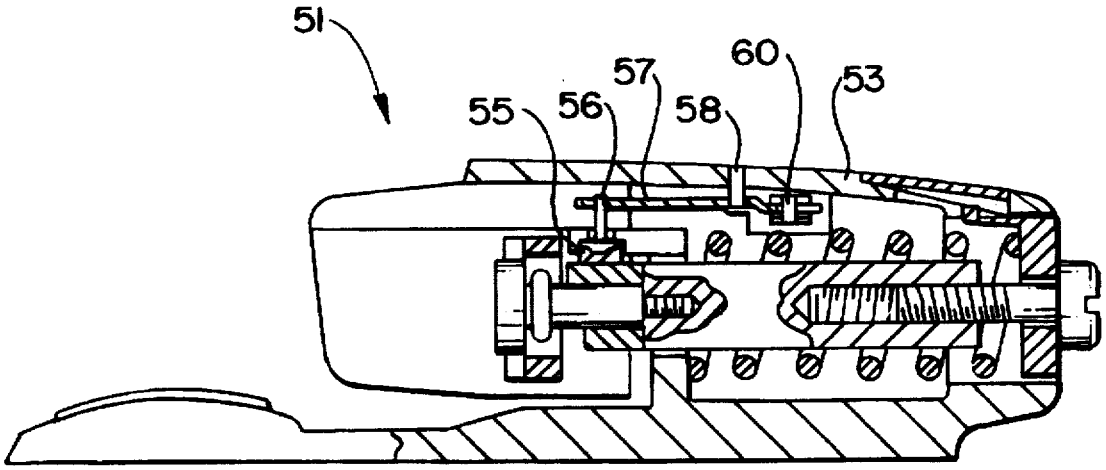
FIG. 15 illustrates in side view and a partial cross sectional view a retention element according to another embodiment of the invention.
Figure 16:
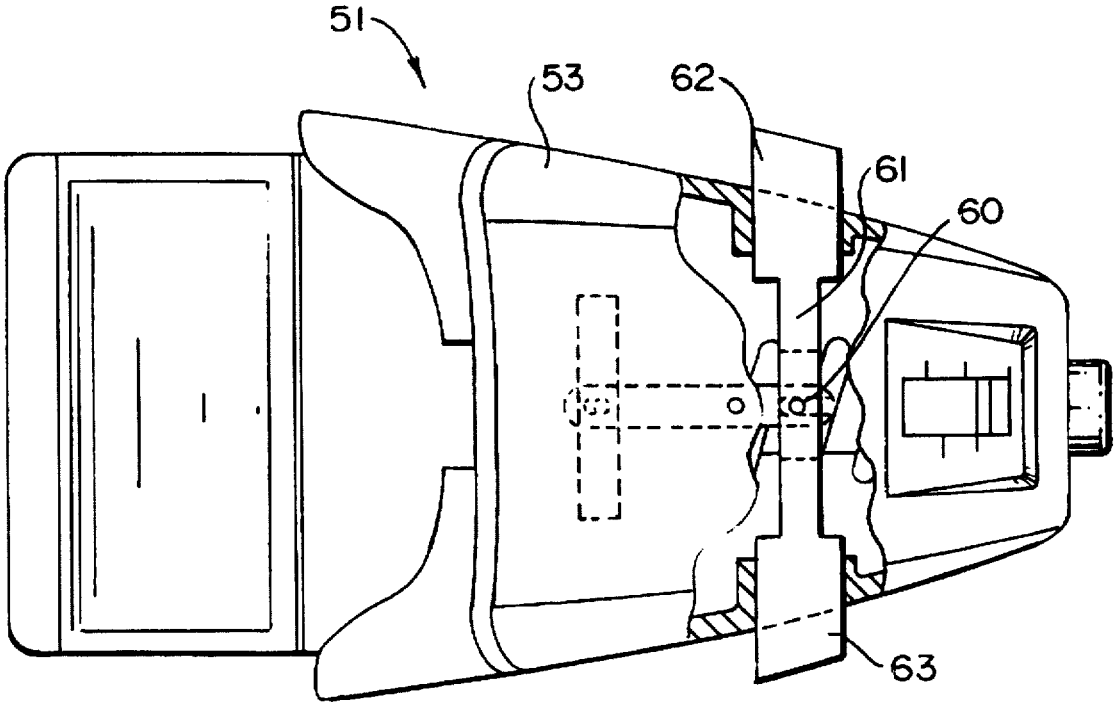
FIG. 16 illustrates in top view and in partial cross section the retention element of FIG. 15.

FIGS. 15 and 16 illustrate another embodiment of the invention. These figures represent a retention element 51 which has a structure identical to element 1. One here finds the tie rod, with the rocker, the ring and the rack. These elements are identical to the elements previously described, with the exception that the rack is not magnetic in the present case.

The rack 55 has a shaft 56 mounted thereon as in the present case. Shaft 56 is manipulated from one side or the other by a longitudinal lever 57 which extends towards the front of the retention element and which is journalled in its central portion around a vertical axis 58 affixed for example to the cap 53. The rear end of the lever has a fork which overlaps the shaft 56 in a horizontal plane. From the other side of the axis 58, lever 57 has another end in the form of a fork, in which is engaged a vertical shaft 60. The shaft is carried by a transverse cursor 61 which is translationally movable. The two ends 62 and 63 of the cursor 61 extend through the cap 53 and laterally project therefrom.

The polarization of a retention element occurs herein in a mechanical manner by support on the cursor positioned on the side of the retention element by means of the other element, of the other ski or of the other boot. For example, the skier engages his two boots in the two retention elements then gives a kick with one of his skis against the interior end of the cursor of the other element, and he repeats the operation for the other foot.

In the present case, the ends of the cursor make it possible by virtue of their position to control the state of polarization of the retention element.

By virtue of this polarization, the wings which are positioned towards the exterior of each of the retention elements are adapted to release the boot more easily, i.e., with a smaller release threshold than the interior wings. The boot of the skier will as a result be freed for a torsional bias of the leg and of the knee of the skier which is weaker towards the interior of the foot than towards the exterior.

The element which has just been described can have means for returning the rack to the central position, and latching means of the ring of the same type as those previously described, or of an equivalent nature.

Figure 17:
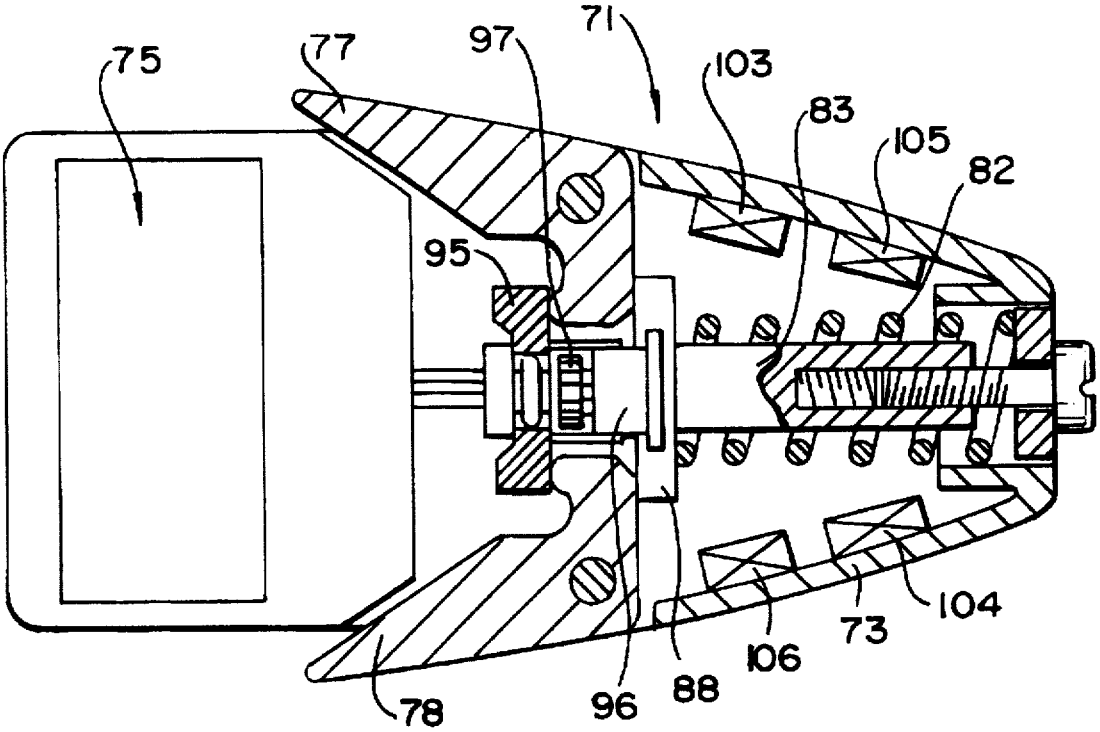
FIG. 17 illustrates in cross section a top view of a retention element according to another embodiment of the invention.
Figure 18:
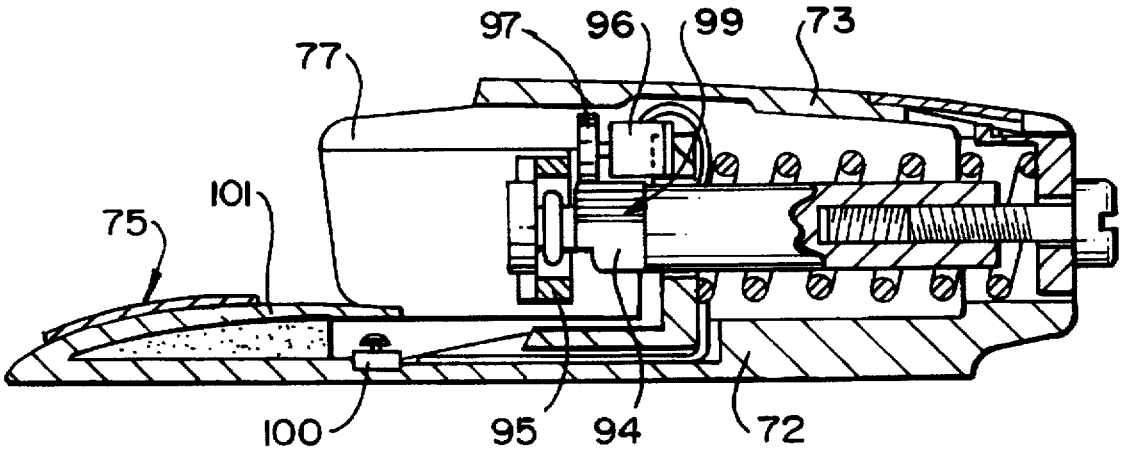
FIG. 18 is a side cross-sectional view of the element of FIG. 17.

FIGS. 17 and those which follow illustrate another embodiment of the invention. The retention element 71 shown to illustrate this embodiment has a mechanical structure of the same nature as that which has previously been described, particularly with a base 72, a cap 73, a support plate 75, retention wings 77 and 78, a spring 82, and a tie rod 83, a support wall 88. The tie rod carries a ring 94 which a channeled zone 99 and a rocker 95. The ring is here manipulated by a small electric motor 96 having at its output a toothed wheel 97 having a pitch corresponding to the channels of ring 94. The motor and the wheel are adapted to drive the ring rotationally by a quarter of a turn on both sides of its median position, which polarizes the retention element as the right or left element, as this is described with reference to FIGS. 7–11.

The motor 96 is for example affixed to the wall 88. It is controlled by an electronic circuit comprising on each side of the retention element a transmitter element, respectively 103, 104 and a receiver element, respectively 105, 106. Functional schematic diagrams of this circuit are given by way of illustration in FIGS. 20 and 21. The motor and the electronic circuit are supplied with current by a known battery and coupled by electric means of a known type, which will not be described in detail. Preferably, the transmitting elements and receiving elements of a same retention element are positioned in staggered rows.

Figure 19:
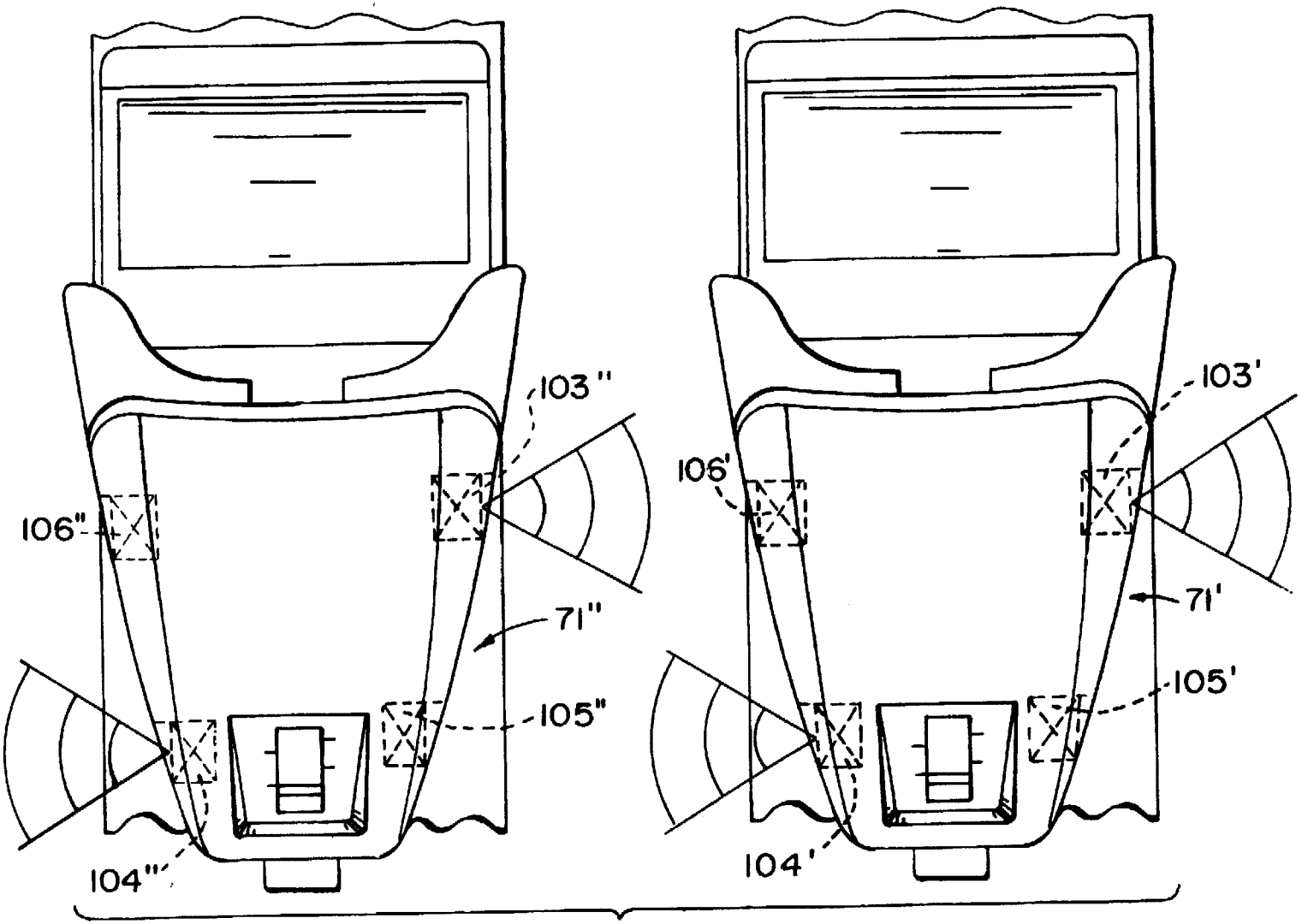
FIG. 19 illustrates in top view, side by side, two retention elements formed according to the embodiment of the invention of FIG. 17.

FIG. 19 illustrates the mode of operation of this assembly. It shows an assembly of two retention elements 71' and 71" positioned side by side, in the position where the skis are ready to be put on the boots.

It is seen in FIG. 19 that the arrangment in staggered rows of the transmitters and receivers makes it possible preferably to have the receiver 106' facing the transmitter 103", and conversely, the transmitter 104' facing receiver 105". Each retention element thus knows its position relative to the receiver which is activated.

The transmitter and receiver elements are of any appropriate type. They are adapted to transmit the signals in a directional manner over a short distance. These signals can be coded. For example, it is a question of a transmitter and a receiver of the infra-red type of the type which are utilized in television remote controls. They can also be elements such as those utilized for the remote opening of front gate, or the centralized latching of the doors of a vehicle. One can also use elements of the optical type, with a light transmitting element and a photo electric cell. One could also utilize more complex circuits, for example, of the resonance type or circuits utilizing a magnetic field which one disturbs by introducing in the covered field a foreign element of the other retention element.

Figure 20:
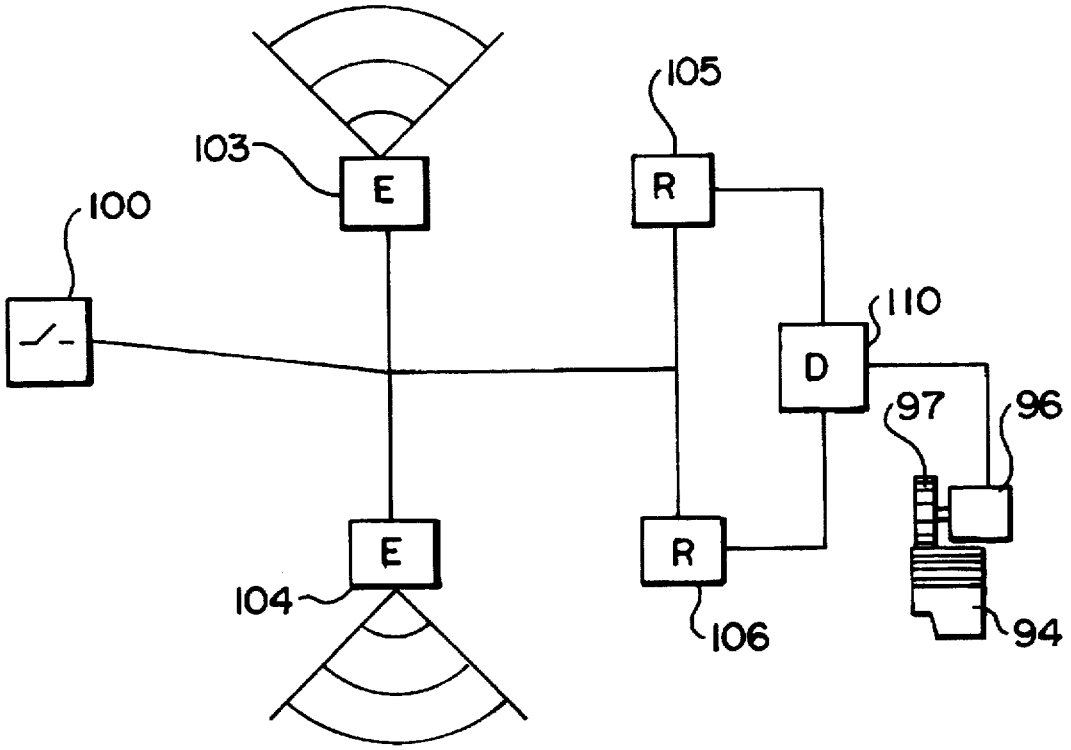
FIG. 20 is a functional schematic diagram which illustrates a mode of operation of the retention element of FIG. 17.

FIG. 20 illustrates a first functional schematic diagram for control which can be put into operation. To simplify comprehension, it is understood that the transmitter and receiver elements which are used are of a simple type, i.e., with a transmitter element adapted to emit a signal, and a receiver adapted to sense the signal of the transmitter.

This schematic diagram comprises an interrupter 100 which reacts to the presence and absence of the boot, for example with the engagement of the boot and its release. For example, the support plate is constructed, as the preceding plate, with a movable portion 101. Interrupter 100 is placed under the movable end of the plate.

The interrupter feeds the two transmitters 103 and 104 and the two receivers 105 and 106. The two receivers 105 and 106 are furthermore coupled to a discriminator 110 which determines which of the receivers 105 or 106 is activated by a transmission of signals originating from the other retention element.

Depending upon whether the receiver activated is the right or left receiver of the retention element, the discriminator controls the rotation of motor 96 of the ring 94 to bring it to the appropriate polarized position.

When interrupter 100 is no longer activated by the boot, the transmission of the signal ceases. One can provide in this case that the discriminator brings back the ring to the median position, in a manner such that it is ready for another insertion of the boot. This is however not essential.

Figure 21:
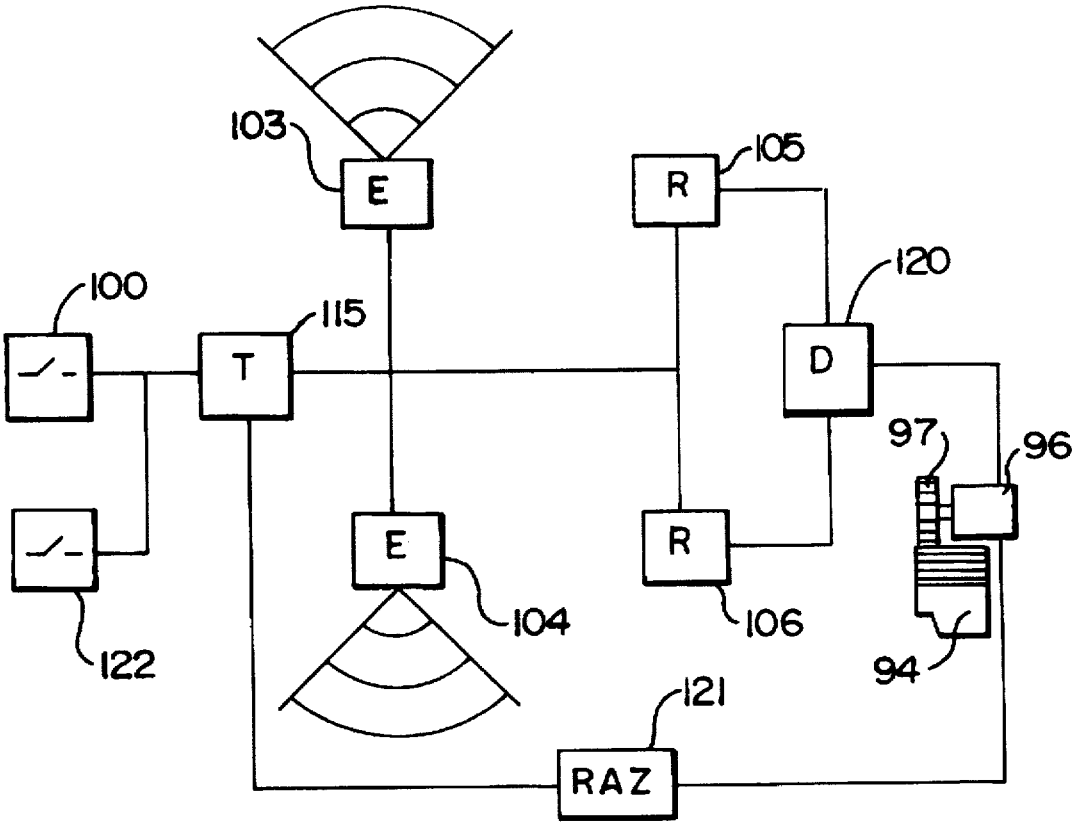
FIG. 21 relates to an alternative embodiment of the functional schematic diagram of FIG. 20.

FIG. 21 illustrates an alternative embodiment of the functional schematic diagram. According to this variation, interrupter 100 is coupled to a timing circuit 115 which activates the two transmitters 103 and 104 and the receivers 105 and 106 for a predetermined period of time, for example a duration of one or two minutes after the engagement of the boot.

As in the preceding case, a discriminator 120 is coupled to the two receivers. However, here its only function is to pilot the correct positioning of the ring as a function of the receiver which is activated during the predetermined period of time.

Indeed, the circuit has in a preferred manner a zero reset circuit 121 which is coupled to the timing circuit 115, whose function is to bring back the ring to the median position when the boot is releasead.

Likewise preferably, a second interrupter 122 is positioned in an accessible manner. For example, it is adapted to the upper surface of the cap, so as to be able to be manipulated by the ski pole. This interrupter is positioned in parallel on interrupter 100, and its function is to voluntarily reactivate the timing circuit during the predetermined period of time. This switch will in particular be utilized if the other ski is put back on after an accidental release of the boot, in a manner so as to transmit signals which will allow the other retention element to be again polarized. In effect, the zero reset circuit 121 of this retention element will have brought the ring back to the median position for liberation of the boot.

These functional schematics are given only by way of example, they should not be construed as having a limiting effect on the invention. There exists in effect other possibilities.

Figure 22:
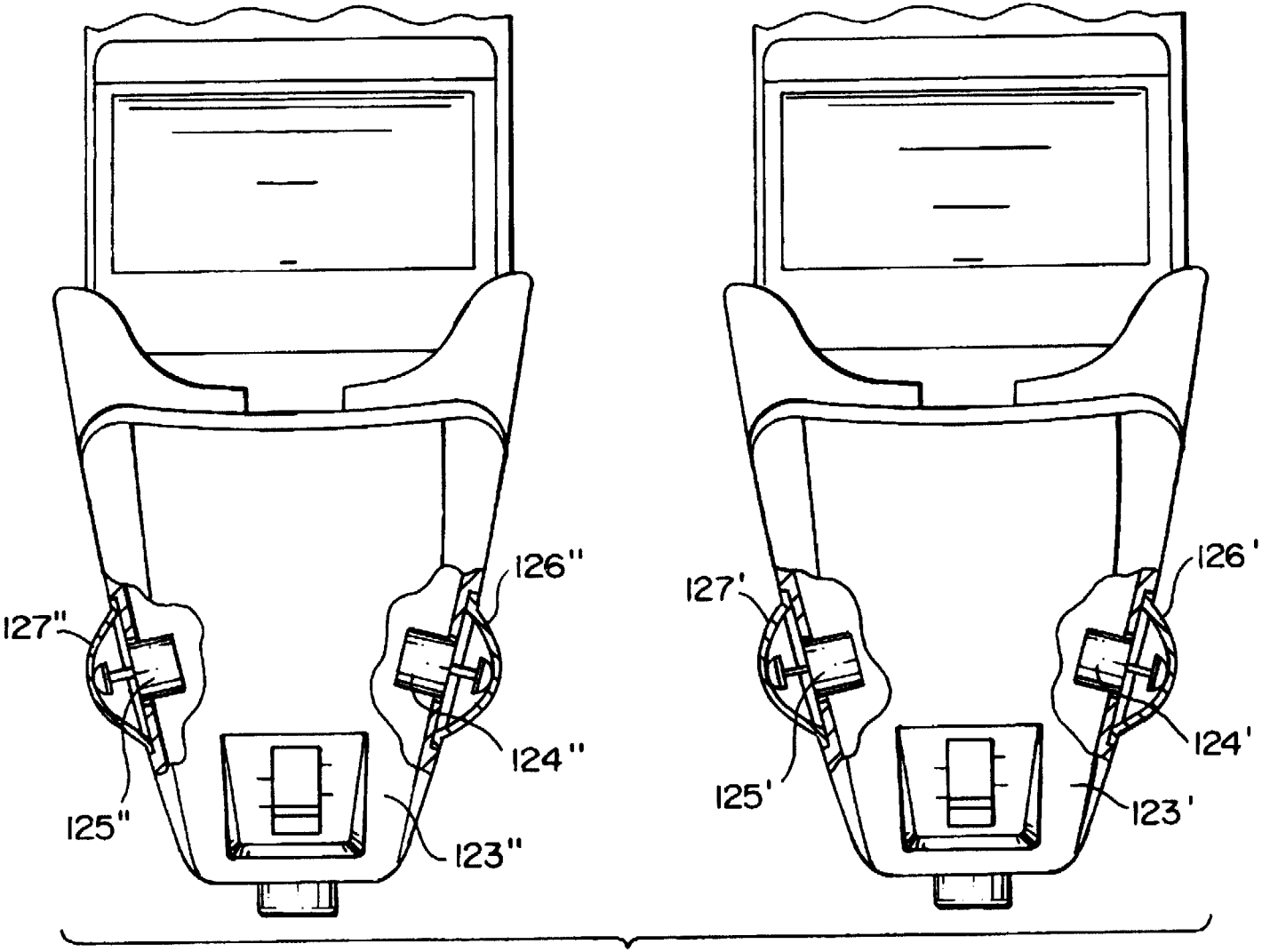
FIG. 22 illustrates an alternative embodiment of the invention.
Figure 23:
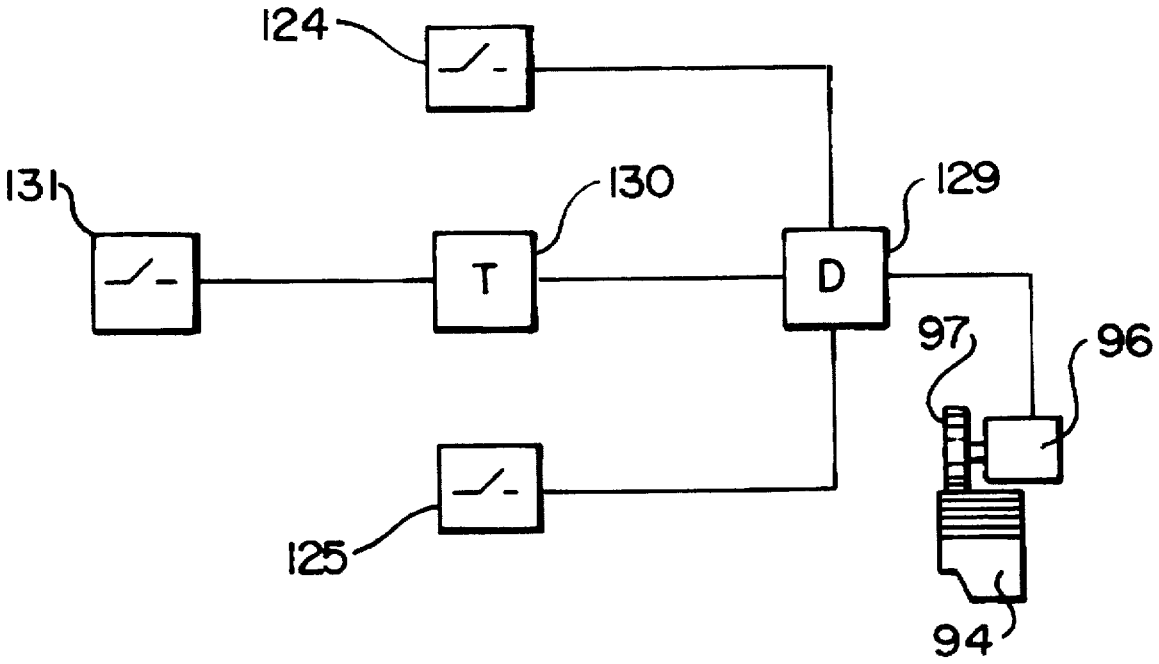
FIG. 23 is a schematic functional diagram which explains a possible mode of operation of the embodiment of FIG. 22.

FIG. 22 illustrates an alternative embodiment. The transmitters and receivers are here replaced by a simple interrupter.

Thus, the figure shows two retention elements 123' and 123" positioned side by side. Each element has on each side an interrupter 124', 125', 124", 125", whose movable portion extends through the lateral wall of the cap. To the exterior of the cap of the retention element, the movable portion of the interrupter is protected by a wall of rubber in the form of a bubble 126', 127', 126", 127" This is not however essential and any other appropriate means may be used.

The principle of operation of this embodiment is the following. When the boot is put onto the ski, the skier activates the interior interrupter of each retention element with an element of the other ski, i.e., for example the ski itself, the boot, the retention element or the other interior interrupter.

Upstream, a discriminator circuit 129 detects which of the two switches has been activated, and controls the motor 96 in a manner so as to bring the ring 94 into the polarization position corresponding to the right or left position of the retention element.

In order to avoid that the adjustment be modified in the course of skiing, one can provide a timing circuit 130 controlled by switch 131 sensitive to the engagement and to the release of the boot. The timing circuit activates the discriminator for a predetermined period of time after the engagement of the boot. After this duration in the course of which the skier is supposed to perform the necessary manipulations for the polarization of his retention elements, the circuit 130 neutralizes the discriminator until the boot is liberated. Upon liberation of the boot, one can provide that the timing circuit and the discriminator control the motor to return to its median position.

As for the preceding case, other modes of operation are likewise possible. What is important here is that the retention elements are polarized by a natural movement which depends directly on the position that the elements occupy to the feet of the skiers.

The instant application is based upon French Patent Application No. 94 14073, filed Nov. 21, 1994, the disclosure of which is hereby incorporated by reference thereto, and the priority of which is hereby claimed under 35 U.S.C. §119.

Furthermore, the invention is not limited to the mechanical constructions which have been described, numerous variations exist, depending upon whether the jaw has two independent wings, or two wings whose lateral movement is linked, or depending upon whether body of the retention element is affixed to the ski or movable with the jaw.

Finally, although the invention has been described with reference to particular means, materials and embodiments, it is to be understood that the invention is not limited to the particulars disclosed and extends to all equivalents within the scope of the claims.

What is claimed:

1. An assembly of two retention elements for retaining two boots of a skier on two skis, the two skis adapted to be interchangeably attached to either leg of a skier, each retention element comprising:

a retention jaw adapted to retain one end of the boot, the jaw having a boot engaging portion movable laterally at least in a horizontal plane between inward and outward directions relative to a central position where the boot engaging portion is aligned with a longitudinal median plane defined by the ski, the inward direction, with respect to either of the two retention elements, being a direction toward the other of the two retention elements and the outward direction being a direction away from the other of the two retention elements;

a spring for returning the jaw to its aligned position;

a linkage for transmission of movement between the retention jaw and the spring which compresses the spring upon lateral movement of the boot engaging portion from one side or the other of its aligned position, and which sends back to the Jaw an elastic return force for biasing the boot engaging portion towards its aligned position;

the jaw and the spring being adapted to free the end of the boot in response to a predetermined release threshold force corresponding to a predetermined amplitude of displacement of the Jaw and to a predetermined extent of compression of the spring;

an adjustment mechanism acting on the transmission linkage to modify in a differential manner inward and outward release threshold forces of the jaw corresponding to inward and outward directions of movement respectively of the boot engaging portion;

a manipulation element adapted to automatically interact with a corresponding manipulation element on the other retention element to control the adjustment mechanism of each retention element for reducing one of the inward and outward threshold forces and increasing the other one of the inward and outward threshold forces on the two retention elements when the skis are interchanged.

2. Assembly according to claim 1, wherein the two retention elements are identical.

3. Assembly according to claim 1 further comprising a latch adapted to block in a releasable manner the adjustment mechanism.

4. Assembly according to claim 3 further comprising an elastic return element of the adjustment mechanism to the median position.

5. Assembly according to claim 1 wherein for the retention elements, the manipulation element is a magnetized bar oriented along a transverse direction, and guided by a translational movement along this transverse direction.

6. Assembly according to claim 5 wherein the magnetized bar is engaged on a ring, the bar controlling the rotation of the ring by virtue of displacement of the bar in translation.

7. Assembly according to claim 5 wherein the cap of each retention element has at least one window positioned along the path of displacement of the bar.

8. Assembly according to claim 1 wherein each element has a transverse cursor, the cursor having two ends project from each side of a wall of the retention element.

9. Assembly according to claim 8 wherein the cursor is connected to an end of a lever journalled around a fixed axis.

10. Assembly according to claim 8 wherein another end of the lever is connected to a rack oriented along a transverse direction, and guided for a translational movement along this transverse direction.

11. Assembly according to claim 1 wherein the adjustment mechanism comprises an electric motor.

12. Assembly according to claim 11 wherein the manipulation element comprises for each retention element two signal transmitters, and two signal receivers, a transmitter and receiver being placed on each side of the retention element.

13. Assembly according to claim 12 wherein the two receivers are coupled to a discriminator adapted to determine which of the two receivers is activated by one of the transmitters of the other retention element.

14. Assembly according to claim 1 wherein the manipulation element comprises for each retention element two interrupters, one on each side, whose movable portion projects so as to be accessible from the other retention element.

* * * * *